US006484662B1

(12) United States Patent
Perucca

(10) Patent No.: US 6,484,662 B1
(45) Date of Patent: Nov. 26, 2002

(54) REFLECTIVE RESCUE SIGNALING DEVICE

(76) Inventor: Dennis C. Perucca, 12652 Susan La., Garden Grove, CA (US) 92841

( * ) Notice: Subject to any disclaimer, the term of this patent is extended or adjusted under 35 U.S.C. 154(b) by 0 days.

(21) Appl. No.: 09/876,872

(22) Filed: Jun. 8, 2001

(51) Int. Cl.[7] ..... B63C 9/00

(52) U.S. Cl. ..... 116/209; 441/80

(58) Field of Search ..... 116/209, 200, 116/210, 211, 107, 109, 110; 441/80, 89

(56) References Cited

U.S. PATENT DOCUMENTS 4,586,456 A * 5/1986 Forward ..... 116/210
4,872,414 A * 10/1989 Asquith et al. ..... 116/210
5,020,467 A * 6/1991 Van Patten et al. ..... 116/210
5,199,374 A * 4/1993 Blanchette ..... 116/209
2001/0024916 A1 * 9/2001 Cynamon ..... 441/80

* cited by examiner

*Primary Examiner*—Diego Gutierrez
*Assistant Examiner*—Erich Linn, Jr.
(74) *Attorney, Agent, or Firm*—Gordon K. Anderson

(57) ABSTRACT

A reflective rescue signaling device for revealing a specific location of a person in distress from a distance, which includes a buoyant container (30) provided with an attachment ring (38) to which a lid (50) is removably attached. The container is equipped with an attaching loop (42) having a bore (44) for fastening the container to an object or onto a person. The lid has a handle (70) on one side and a spindle (58) on the other to which a length of reflective tape (94) is rolled. The tape is attached on one end to the spindle and on the other to an inside surface of the container such that when the lid is removed the reflective tape may be unrolled from the spindle and thrown or dropped into the water When on land the tape may be manually unrolled and placed in an open clearing or on top of vegetation for visual recognition and identification from a distance or to indicate direction.

18 Claims, 4 Drawing Sheets

12
70
60
66
58
68

12
15
70
66
60
74
72
72
74
68
58

78
76
60
80
62
58
68

82
60
58

15
82
60
58

86
70
60
58

66
70
60
74
72
72
74
58

84
70
60
58

88
70
60
58

92
60
58

66
90
70
62
60
58

70
60
64

58
68

REFLECTIVE RESCUE SIGNALING DEVICE

TECHNICAL FIELD

The present invention relates to signaling devices in general. More specifically to a visual indicating double sided reflective signal rescue tape that is extended outwardly for achieving visual identification from a distance.

BACKGROUND ART

Previously, many types of signaling devices have been used in endeavoring to provide an effective means for locating lost persons on both the land and on water. Many inventions have been made by those knowledgeable in the art such as flares, balloons, signal transmitters and the like. As an example Howard in U.S. Pat. No. 4.416,212 teaches a rescue signal to be used in the water which is defined by a tube of thin flexible material about the length of a persons arm and about the width of his hand. The tube is preferably colored international emergency orange. A flag of similar material, except of a contrasting color, is fastened to the end of the tube. When not in use and for storage the device is stowed in a compact package and carried in a downward opening pocket on the users life jacket.

Another approach to rescue equipment is disclosed in U.S. Pat. No. 4,079,364 issued to Antemore on Mar. 14, 1978 in which he discloses an alarm apparatus worn by a person when traveling or being around open water. The device is activated by itself when immersed in water. If the wearer should accidentally fall into the water an alarm will automatically sound without any action required by the user. The alarm is mounted in a buoyant housing constructed such that the device will be self-righting and float to the surface of the water in a upright position permitting the alarm signal to be emitted outwardly from the water when the housing reaches the surface. Various embodiments and actuating release circuits are disclosed in this patent of Antemore.

Other approaches have been taken by prior art to signal an emergency if a person falls unavoidably into a body of water, such as signal transmitters and satellite positioning electronic equipment that sends a signal indicating the actual location of the emergency. Simple pieces of shaped colored material have been used on land to spell out emergency messages for air searches that may be carried on ones person when traveling in remote areas.

DISCLOSURE OF THE INVENTION

The problem of locating people by rescuers has been with us for centuries as people sometimes become lost or injured in remote areas and boating accidents happen unexpectedly. While this occurrence is normally rare and unusual, incidents do transpire that are beyond the persons control however with preplanning and forethought ones life may be saved. It is therefore a primary object of the invention to provide a signaling device that is light in weight and compact enough to be carried on ones person without undue discomfort or annoyance particularly when wearing a life vest. The signaling invention presented is small enough to be attached easily to a life preserver in an out of the way position. Further the same device may be carried in a backpack or haversack when traveling in the back country or remote areas away from civilization. The invention may be also easily carried in an aircraft or an off-road vehicle where rescue may be achieved when location and identification is required.

An important object of the invention is the ease of recognition from a distance as the device incorporates a 50 foot (15.24 meter) tape of floatable material that has one side coated with a florescent emergency orange color and the other side a reflective silver surface. This tape is stored in a floatable container and when used is pulled out and thrown into the water. The lid of the storage container floats as does the tape and as it unrolls, when thrown, a streamer is created that has sufficient length to be recognized from great distances. In the water both the color and reflective surface may be visualized as it does not always lay straight allowing the reflective surface to glimmer in the sun and the fluorescent color to be recognized simultaneously. The tape or ribbon has sufficient width to be seen from an aircraft and its length is adequate for visual identification even on large bodies of water. On land the tape may be manually placed in an open clearing and either laid straight or folded with an arrow on one end to indicate position or location. If the survivor is injured on land and unable to move the tape may still be thrown and unravel as a streamer which may be visible from a distance.

Another object of the invention is its lightness, as it weighs only 10 ounces (311 grams), in the preferred embodiment. This is light enough to be carried without discomfort particularly if the user is on the water in a boat. The device may easily hang with a snap fastener on a belt loops or on a floatable vest on one of the ties or a loop furnished for the purpose. If the invention is included in the emergency gear of a backpacker the additional weight is not objectionable in view of the advantage gained.

Still another object of the invention is related to its physical size as it is only 3⅜ inches (8.6 cm) in diameter and 4¼ inches (10.8 cm) high, plus the handle, which is small enough to not be a bother hanging on the person and certainly not objectionable if placed in a bag or vehicle. Further, in the preferred embodiment, the body of the container is formed of a closed cell sponge and has a tough durable sin on the outside surface. If the body is stored in a cramped space and dents inwardly, when the compression is relieved, the material will return to its normal shape due to its inherent memory.

Yet another object of the invention is that it is easy and quick to use since all that is required is that the lid be removed and the tape is manually unrolled or in the case where on the water thrown a distance away from the user or even dropped into the water permitting the material to unroll by itself and, since it floats it, will disperse itself in time by the natural movement of the water sufficiently to expose its surface for identification from a distance.

Perhaps one of the most important objects of the invention is the minimal cost of the device as it is considerably less expensive than most of the prior art apparatus available in today's market. Since many of the presently available emergency devices utilize electronic circuits, producing sound and light or RF signal generators, the cost is obviously commensurate with this utility. The instant invention circumvents this expense by using a simple mechanical two sided tape that is unrolled and provides unparalleled visual identification without the need for electrically operated circuits.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 6:
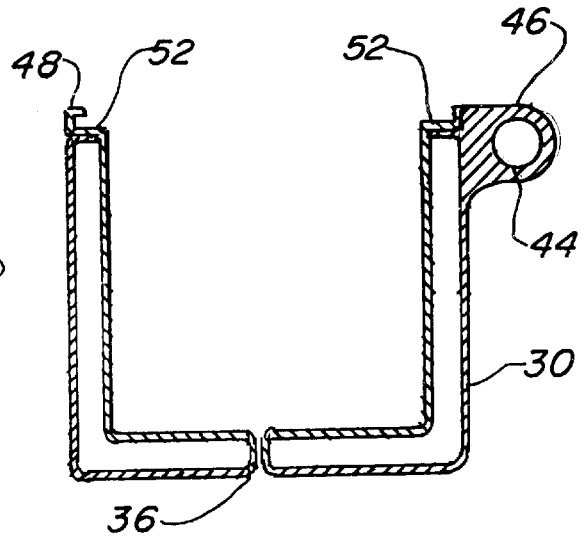
FIG. 6 is a cross-sectional view taken along the centerline of another embodiment of the container integrally injection molded together with a drain hole in the bottom and integral means for attaching and fastening.
Figure 7:
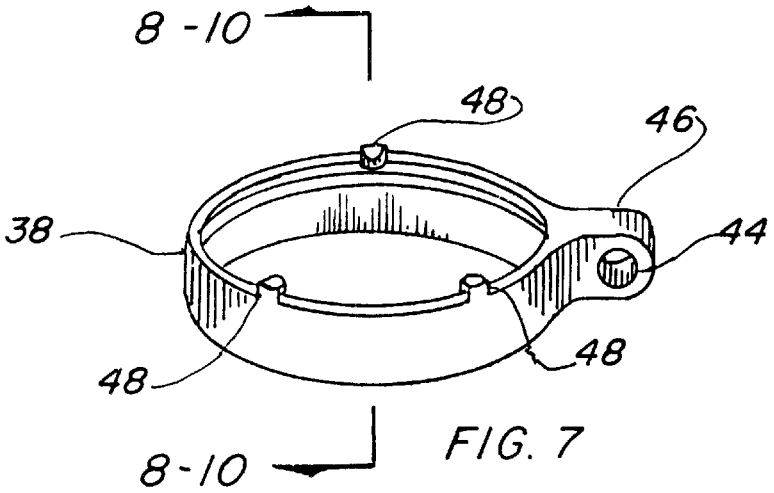
FIG. 7 is a partial isometric view of the container attachment ring in the preferred embodiment completely removed from the invention for clarity.

The best mode for carrying out the invention is presented in terms of a preferred embodiment with other variations in configuration of the principal elements. This preferred embodiment is shown in FIGS. 1–5, 7, 8, 11, 12 and 23 and is comprised of an insulated cylindrical container 30 that has an open top and a closed bottom much like a cup for containing liquids. The container 30 is illustrated in FIGS. 1–4 as assembled also by itself in FIGS. 5 and 23. The container is preferably made of a closed cell sponge material with a specific gravity of less than one permitting it to float in water. The closed cell material is formed with a tough durable outer skin either of the same material or the outside surface may be painted or a gel coat applied to the mold during the manufacturing process. In any event the color of the container 30 will be bright and vivid commensurate with rescue equipment. The container preferably includes a thermoplastic liner cup 32 on the inside surface to add structural stability to the pliable foam material. This cup 32 has a peripheral lip 34 on the top outside edge contributing to its strength and rigidity. One or more drain holes 36 are provided in the bottom of the container and cup for channeling water and effusing moisture from within. While the container is described and illustrated as being made of sponge material with a thermoplastic cup liner it is not to be construed as the only type of construction anticipated as a hollow injection molded cup-like container may be utilized, as illustrated in FIG. 6, containing the requisite attaching and fastening means integrally formed into the structure. Further any other type of similar construction may function equally well in the application and therefore the form of the container 30 should not limited to that shown and detailed above.

Figure 2:
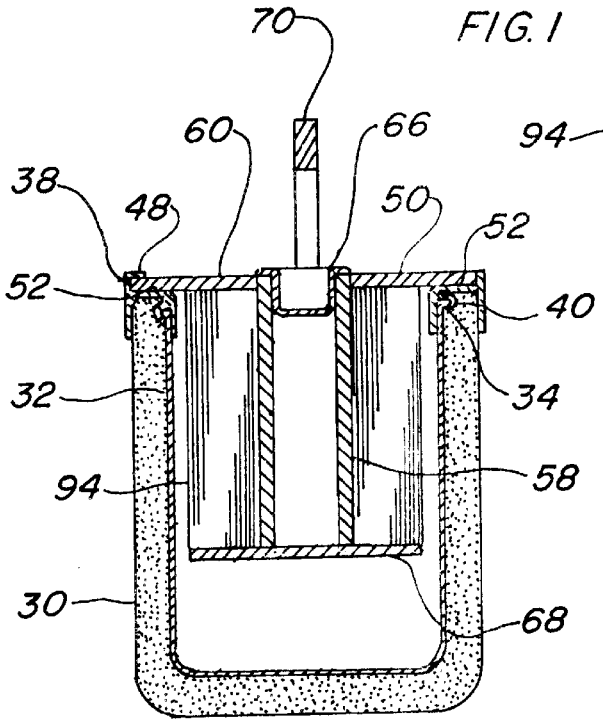
FIG. 2 is a longitudinal cross sectional view of the preferred embodiment taken along lines 2—2 of FIG. 1.
Figure 3:
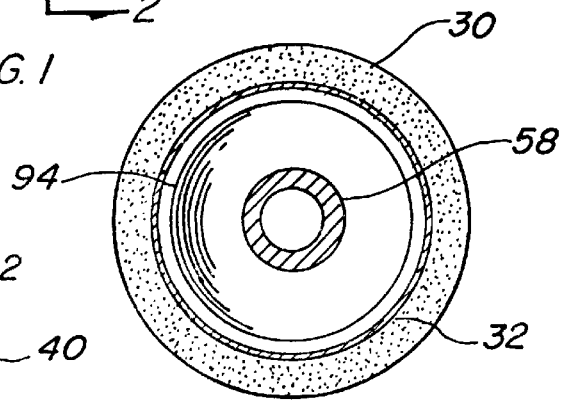
FIG. 3 is a cross sectional view looking down into the preferred embodiment taken along lines 3—3 of FIG. 1.
Figure 4:
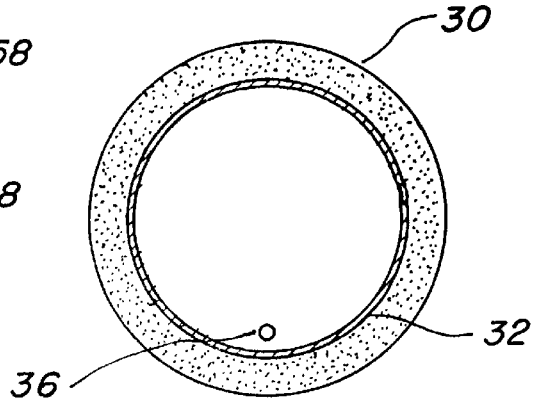
FIG. 4 is a cross sectional view looking down into the preferred embodiment taken along lines 4—4 of FIG. 1.
Figure 5:
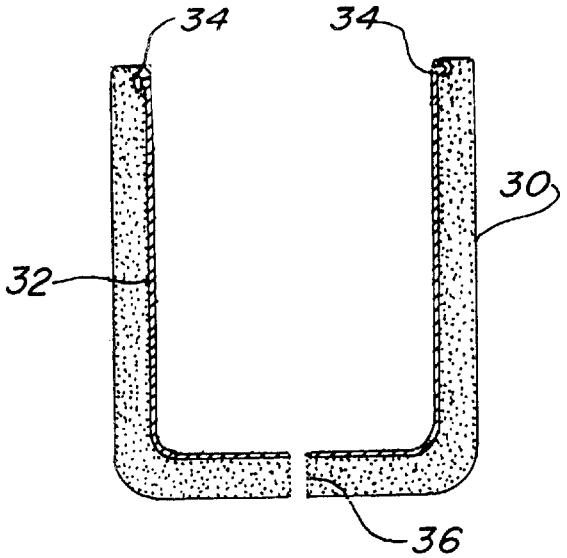
FIG. 5 is an arbitrary cross-sectional view taken along the centerline of the container by itself in the preferred embodiment.
Figure 8:
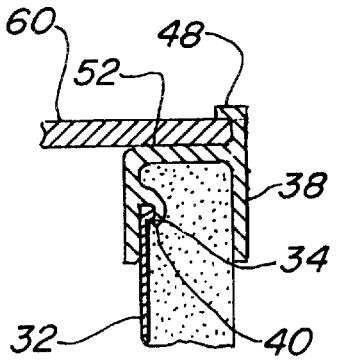
FIG. 8 is a cross-sectional view taken along lines 8—8 of FIG. 7.
Figure 9:
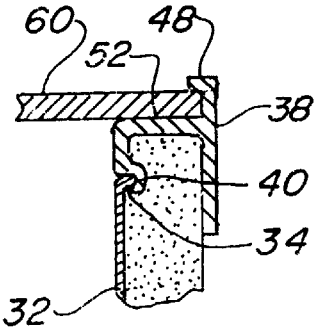
FIG. 9 is a partial cross sectional view of another embodiment of the container attachment ring taken along lines 9—9 of FIG. 7 with only the lid and part of the container shown.
Figure 10:
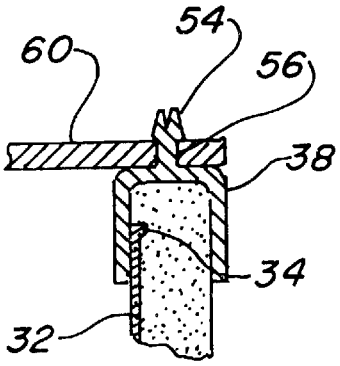
FIG. 10 is a partial cross sectional view of yet another embodiment of the container attachment ring taken along lines 10—10 of FIG. 7 with only the lid and part of the container shown.

A container attachment ring 38 is affixed upon the open top of the container 30 and functions to enclose the container and also for attachment of the invention to an object or a persons clothing. The attachment ring 38 is preferably in a U-shape configuration for mating with the top of the container 30 as shown in FIG. 2 and distends inside and outside of the container creating a gripping interface therebetween. The container attachment ring 38 further includes means to permanently attach the ring to the container in the form of an adhesive such as general purpose glue, rubber cement, resin based high tack adhesive, foam/fabric aerosol adhesive, plastic cement or the like. In order to increase the structural integrity of the bond between the container 30 and the ring 38 the outside of the lip 34 on the cup 32 is utilized with the ring itself formed in a configuration that includes a snap recess 40 and the liner cup lip 34 is snapped into the recess thereby structurally attaching the ring to the container. FIG. 8 illustrates in cross section the interface with the recess 40 and the lip 34 in the preferred embodiment. FIG. 9 depicts another variation of the U-shape ring 38 wherein the distending legs are uneven with the leg containing the snap recess 40 formed even with the inside diameter of the cup 32. FIG. 10 shows yet another embodiment wherein the distending legs are parallel and even in length and they simply slip over the top of the container and are jointly bonded into place with the adhesive.

Figure 1:
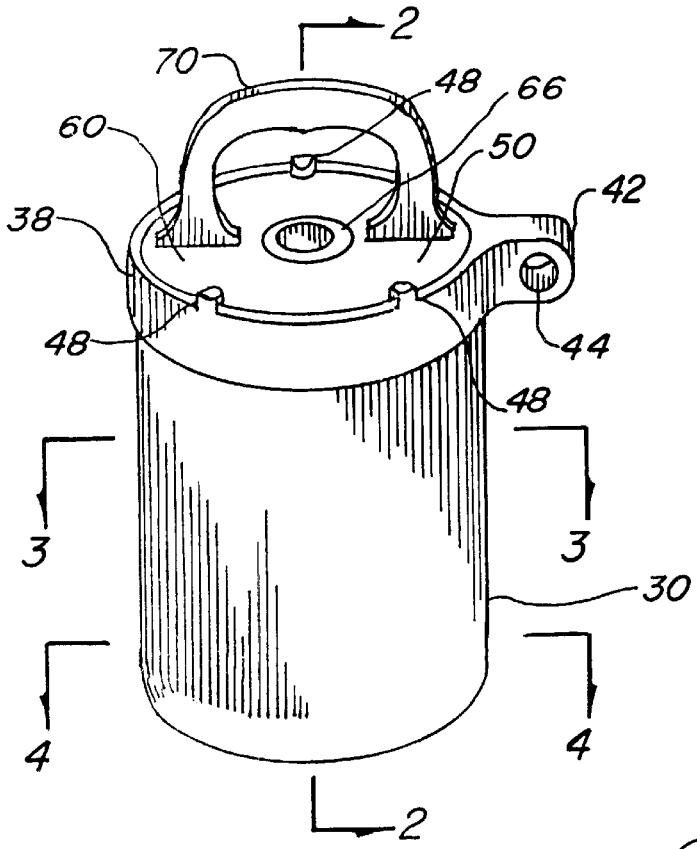
FIG. 1 is a partial isometric view of the preferred embodiment

The ring 38 further contains an attaching loop 42 as shown in FIG. 1 on one side for connection to an article of clothing or some fixed object. The loop 42 is formed integrally with the ring 38 and projects externally from one side. The loop 42 contains a bore 44 in the center and is illustrated as a round hole however it may be any shape such as square, oval, triangular or any other form that still functions as an attaching loop. Normally a snap fastener is hooked into the bore 44 and may even be furnished with the rescue signaling device when sold to the public. Other types of fasteners may be used with equal ease, such as a cord, line, rope or like any of which could be similarly attached through the bore 44. It should be noted that the configuration wherein the entire container 30 and ring 38 are formed together, as illustrated in FIG. 6 and discussed in detail later, will contain the bore 44 in a handle like aperture 46 protruding from one side.

The ring 38 is preferably formed by injection molding using a thermoplastic material in granular form heated to plasticity then forced through sprues and runners into a controlled temperature mold. Any type of thermoplastic material even a thermosetting resin may be used in this application including ABS, cellulose, polycarbonate, polyester, polyethylene, polystyrene, polyvinylchloride and the like.

A plurality of tabs 48 are molded into the uppermost edge of the ring 38 and slightly protrude toward the middle of the ring as depicted in FIGS. 1 and 7–9. Three of these tabs 48 are illustrated as exemplary however any number of tabs may be used with equal ease. The tabs 48 protrude inwardly just enough to permit them to be bent back sufficiently to removably release a lid 50 positioned in a circumferential step 52 formed into the ring 38 itself. An alternative to the use of tabs 48 is shown in FIG. 10 and consists of a number of snap clasps 54 that penetrate holes 56 in a lid 50 for attachment purposes. The snap clasp 54 is well known in the art and consists of a projection with a head slightly larger than the hole 56 and may or may not include a relief slot in the end to permit the head to be compressed when the lid 50 is pulled upwardly by hand when releasing the lid from the ring 38. When the lid 50 is replaced the clasps 54 are forced inwardly until the head is cleared permitting the clasp to snap into place securing the lid 50 into the step 52.

Figures 11, 12, 13, 14, 15, 16, 17, 18, 19, 20, 21, 22:
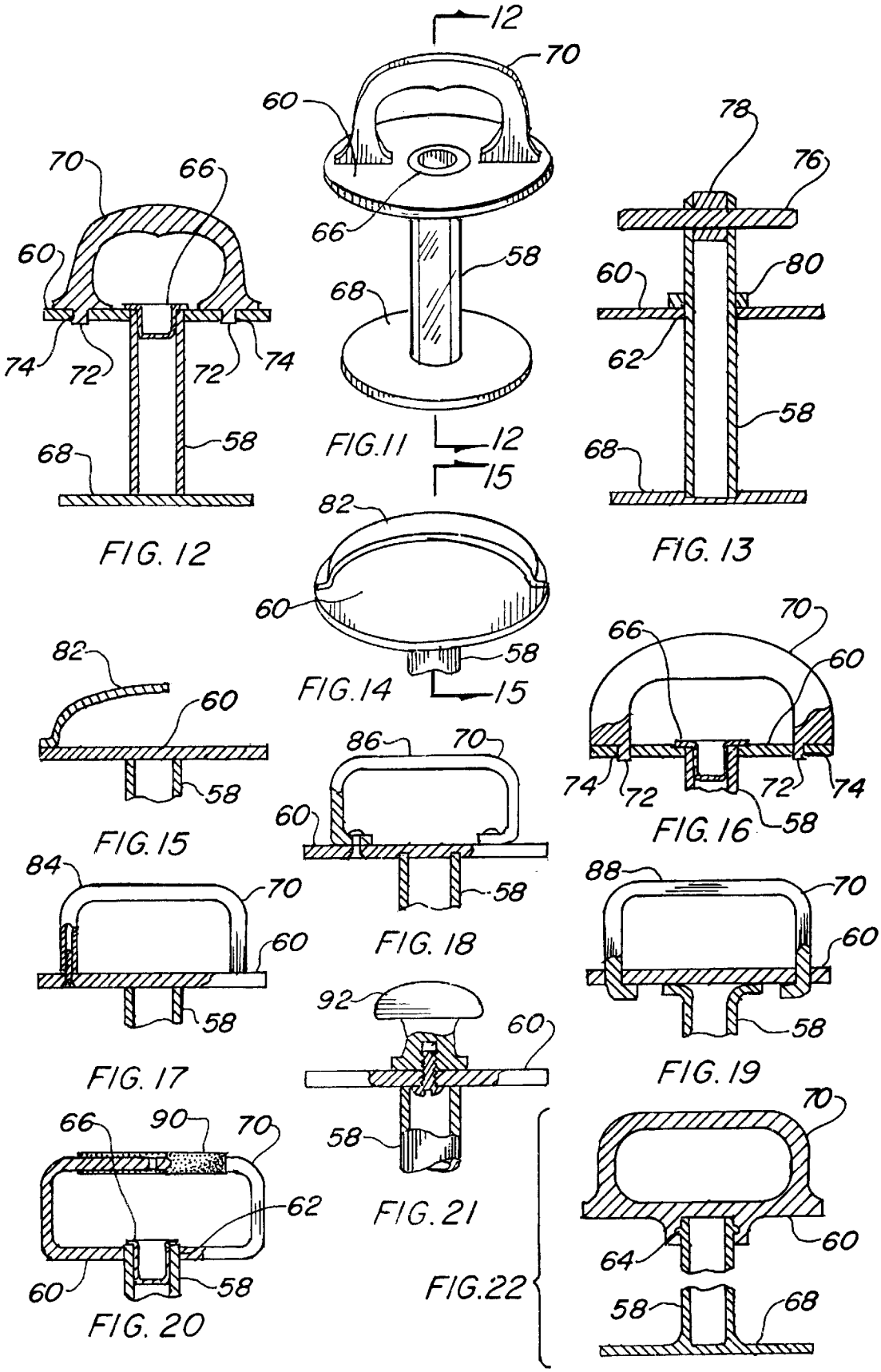
FIG. 11 is a partial isometric view of the container lid in the preferred embodiment completely removed from the invention for clarity.
FIG. 12 is a cross-sectional view taken along lines 12—12 of FIG. 11.
FIG. 13 is an arbitrary cross-sectional view of the container lid with the handle inserted into an extended spindle, completely removed from the invention for clarity.
FIG. 14 is a partial isometric view of the container lid with the handle formed onto the top surface of the lid.
FIG. 15 is a cross-sectional view taken along lines 15—15 of FIG. 14.
FIG. 16 is a partially cut away side elevation view of the lid with the handle die cut and inserted into holes in the lid.
FIG. 17 is a partially cut away side elevation view of the lid with the handle in the form of a hollow tube held in place with threaded fasteners.
FIG. 18 is a partially cut away side elevation view of the lid with the handle in the form of a flat strap bent into a box shape held in place with rivets.
FIG. 19 is a partially cut away side elevation view of the lid with the handle in the form of a solid bar inserted into holes in the lid and held in place by right angle bends on the inside of the lid.
FIG. 20 is a partially cut away side elevation view of the lid with the handle formed with the parent material of the lid bent into a box shape with a cover over the joint where the two ends meet.
FIG. 21 is a partially cut away side elevation view of the lid with a conventional pull handle held in place with a threaded fastener.
FIG. 22 is an arbitrary cross-sectional view of the container lid with the lid and handle integrally injection molded together and the spindle molded separately and snapped into female boss on the lid.
Figure 23:
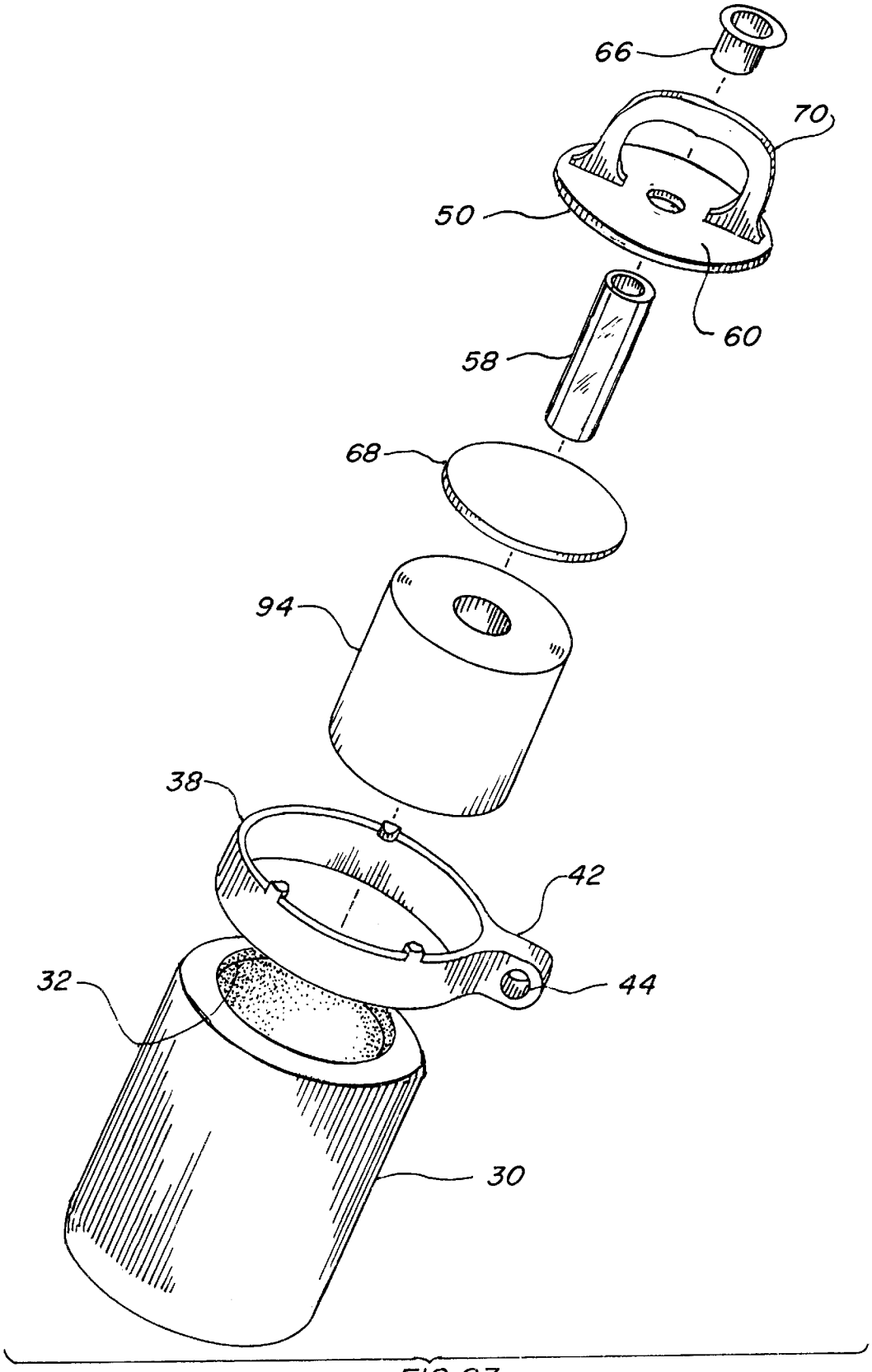
FIG. 23 is an exploded view of the preferred embodiment.

The container lid 50 includes a spindle 58 extending into the container 30 and is removably fastened to the attaching ring 38 as described above. The lid 50 is preferably in the form of a flat disc 60 die cut from a sheet of material as illustrated FIGS. 1,2 11–13 also 22 and 23. The spindle 58 may be attached to the disc 60 using a number of different approaches, as an example FIGS. 14, 15–17 and 21 simply butt the spindle 58 to the center of the disc 60 and permanent attachment is made by cementing the pieces together with adhesive or welding by heating the materials until they fuse together into one homogeneous mass. FIGS. 12, 13, 16 and 20 illustrate a connection by using a mating opening 62 in the disc 60 just slightly smaller in diameter than the outside of the spindle 58 forming a press fit which along with the use of adhesives creates a permanent bond. Another approach is shown in FIG. 18 where a recess is either cut or melted into the center of the disc 60 and the spindle 58 is inserted and then bonded with adhesive. FIG. 19 illustrates yet another method of attachment wherein the spindle 58 is flared under heat and pressure and then glued to the disc on the extended surface created by the flare. A bead 64 may be formed on the spindle 58 and snap into a recess formed integrally in the disc 60 in another embodiment of the lid 50 shown in FIG. 22 wherein the entire lid is injection molded.

In all of the variations of attachment of the spindle 58 to the disc 60 it is desirable to have a dead air space remaining in the hollow of the spindle to permit the lid 50 to be buoyant and float in water. Some of the approaches accomplish this feature by their physical structure while others require some means of closure, therefore a plastic plug 66 is used in these cases which is by itself well known in the art. It will be noted that a secondary advantage may be realized using a plug 66 as the hollow in the interior of the spindle 58 may be used for storage of small articles such as written instructions during emergencies when lost or shipwrecked in the water etc.

A base 68 is permanently attached to the bottom of the spindle 58 as shown in FIGS. 2, 11–13 and 23. This base 68 is formed from a flat sheet and preferably die cut to form a round disc and attached to the spindle 58 with adhesive, welding or the like. FIG. 13 illustrates another approach where a recess is either cut or melted into the center of the base 68 and the spindle 58 is inserted and then bonded in place.

A handle 70 is provided on a top surface of the disc 60 for removing the lid 50 when employing the survival device. There are a myriad of handles 70 that will function properly in this application in most cases the handles are a separate element permanently attached to the lid 50.

FIG. 12 illustrates a die cut handle 70 that is cut to form a pair of fingers 72 on the bottom that are inserted into opposed cavity's 74 in the disc 60 and then bonded into place with adhesive or the like.

FIG. 13 depicts a handle 70 that is fabricated using an elongated spindle 58 with a rod 76 penetrating completely through including an end cap 78 positioned within the open end. A bushing 80 may be used as reinforcing the joint between the spindle 58 and the disc 60 and it should be noted that this bushing may be incorporated into any or all of the various arrangements, if desired.

FIGS. 14 and 15 show a handle 70 that is raised with a half disc 82 attached on the outside to the disc 60 by spot welding or adhesive with the red portion in crescent shape created by heating the material and while pliable forming it into the desired shape.

FIGS. 16 is similar in function to the preferred embodiment of FIG. 12 except in its overall shape.

FIG. 17 illustrates a hollow plastic tube 84 attached through holes in the disc 60 with threaded fasteners.

FIG. 18 depicts a handle 70 in the form of a flat strap 86 bent into a box shape held in place into the disc 60 with rivets.

FIG. 19 shows a handle 70 in the form of a solid bar 88 inserted into holes in the disc 60 and held in place by bending the ends at right angle until they are contiguous with the inside surface of the lid.

FIG. 20 depicts a handle 70 formed with the parent material of the disc 60 bent into a box shape with a resilient cover 90 over the joint where the two ends meet with a substance such as shrink tubing or plastic grip material.

FIG. 21 uses a conventional pull handle 92 held in place with a threaded fastener. While a single knob is shown, conventional drawer pull handles in U-shape may also be used in this application with the selection limited only by their availability.

FIG. 22 shows the disc 60 and handle 70 integrally injection molded together and the spindle 58 with a bead 64 injection molded separately with the spindle bead snapped into a female recess on the lid as previously described.

The material of the die cut handle 70, base 68 and disc 60 may be the same as the as they are similar in construction. This material is preferably a thermoplastic such as ABS, polyethylene, polypropylene, and polystyrene as they have properties that permit buoyancy in water. The spindle 58 may be made of the same material as above however an extruded transparent acrylic tube has also been found to function in a satisfactory manner. Other manufactured handles 70, as described above may be made of various thermoplastic materials such as those available in today's open market. It should also be noted that the length of the spindle 58 does not entirely fill the inside of the container 30 as illustrated however this relationship is of little importance and if the container 30 is manufactured specifically for the purpose as shown in FIG. 6 the space will be minimized or the base 68 may be almost contiguous with the inside surface of the container.

To complete invention reflective tape 94 is bonded on a first end to the spindle 58 and on a second end to an inside surface of the container 30. The tape 94 is rolled upon the spindle such that when the lid 50 containing the spindle is removed the reflective tape may be unrolled from the spindle into a distended ribbon form suitable for visual identification from a distance. Bonding of the tape 94 is accomplished by the use of conventional adhesives obviously on the first end when initially rolling the tape on the spindle. The final bond on the second end is accomplished by placing the adhesive on the outside surface of the tape 94 and when inserting the roll into the interior of the container 30 pressing the tape against the inside surface of the container until the tape adheres sufficiently to separate it from the roll.

The reflective tape 94 is double sided and formed basically of mylar thermoplastic with one side silver metalized polyester film with acrylic adhesive and a so called stay-flat liner and the other a no slip homopolymer LDPE in a bright fluorescent orange color. The preferred reflective tape 94 is distributed by Nadco Inc. of Dover N.H. under the Product number M-1000TC-90P and Construction number M-1000: 0.001" for the polyester film and Product number 9400 1.00 mil No Slip Homopolymer LDPE for the color side. The combined tape has a thickness of 0.0055 inches (0.1397 mm ) including the liner and adhesive to bond the two sides together. The preferred width is 2.25 inches (5.715 cm) and the length is 50 feet (15.24 meters) however other sizes may be used with equal ease and dispatch.

In use, the invention is secured to an object or on a person and when rescue is required the lid 50 is removed and the tape 94 is manually unrolled, or in the case where on the water thrown a distance away from the user or even dropped into the water permitting the material to unroll by itself As previously stated, since both the lid 50 and reflective tape 94 float, the tape will disperse itself by the movement or currents in the water sufficiently to expose its surface for identification from a distance. As the tape 94 unrolls when thrown, it creates a streamer that has a length of some 50 feet (15.24 meters) which is sufficient to be recognized from great distances. In the water both the color and reflective surface may be visualized as it does not always lay straight allowing the reflective surface to glimmer in the sun and the fluorescent color to be easily seen by contrast.

On land the tape 94 may be manually placed in an open clearing or on top of vegetation and either laid straight or folded with an arrow on one end to indicate position or location. If the survivor is injured on land and unable to move the tape may still be thrown and unravel as a streamer which may be visible from a distance.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

What is claimed is:

1. A reflective rescue signaling device for signaling rescuers for individuals in distress on land or water comprising:

a buoyant cylindrical container, having an open top and a closed bottom, a container attachment ring affixed upon the open top of the container, for enclosing the container and for attachment to an object or a persons clothing, a container lid removably fastened upon the attaching ring, with the lid having a spindle extending into the container, and reflective tape bonded on a first end to the spindle and on a second end bonded to an inside surface of the container with the tape rolled upon the spindle such that when the lid is removed the reflective tape may be unrolled from the spindle into a distended ribbon form suitable for visual identification from a distance.

2. The reflective rescue signaling device as recited in claim 1 wherein said cylindrical container is a closed cell sponge having a specific gravity of less than one.

3. The reflective rescue signaling device as recited in claim 1 wherein said cylindrical container further comprising, a thermoplastic liner cup on an inside surface of the container.

4. The reflective rescue signaling device as recited in claim 1 wherein said container and liner cup have drain holes therethrough for effusing moisture.

5. The reflective rescue signaling device as recited in claim 1 wherein said container attachment ring is in a U-shape configuration mating with the top of the container and distending inside and outside of the container creating an gripping interface therebetween.

6. The reflective rescue signaling device as recited in claim 3 wherein said container attachment ring further comprises means to permanently attach the ring to the container.

7. The reflective rescue signaling device as recited in claim 6 wherein said means to attach the ring to the container is an adhesive.

8. The reflective rescue signaling device as recited in claim 6 further comprising, said ring having a snap recess integrally formed therein and said liner cup having a lip on a top outside edge with the lip snapped into the recess defining said means to attach the ring to the container.

9. The reflective rescue signaling device as recited in claim 1 wherein said container attachment ring further comprises an attaching loop having a bore therethrough for fastening the signaling device to ones person or a fixed object.

10. The reflective rescue signaling device as recited in claim 1 wherein said container lid is buoyant in water and further comprises a handle on a top surface for removing the lid when employing the survival device.

11. The reflective rescue signaling device as recited in claim 10 wherein said handle is a separate element permanently attached to the lid.

12. The reflective rescue signaling device as recited in claim 10 wherein said handle is integrally formed with the parent material of the lid.

13. The reflective rescue signaling device as recited in claim 1 wherein said reflective tape is double sided.

14. The reflective rescue signaling device as recited in claim 13 wherein said double sided tape reflective tape is fluorescent orange on one side and mirror like silver on the other.

15. The reflective rescue signaling device as recited in claim 13 wherein said double sided tape is mylar thermoplastic.

16. The reflective rescue signaling device as recited in claim 13 wherein said double sided tape is bonded on both the first end and the second end with adhesive.

17. A reflective rescue signaling device for signaling rescuers for individuals in distress on land or water comprising:

a container, having an open top and a closed bottom with fastening means to attach the survival device to an object or a persons clothing, a lid removably fastened upon the container having a spindle extending into the container, and reflective tape bonded on a first end to the spindle and on a second end bonded to an inside surface of the container with the tape rolled upon the spindle such that when the lid is removed the reflective tape may be unrolled from the spindle into a distended ribbon form suitable for visual identification from a distance.

18. A reflective rescue signaling device for signaling rescuers for individuals in distress on land or water comprising:

a container, with fastening means for attachment to an object or a persons clothing, a lid having a spindle extending into the container with the lid removably affixed onto the container, and, a length of reflective tape rolled upon the spindle such that when the lid is removed the reflective tape may be unrolled from the spindle for visual recognition and identification from a distance.

* * * * *